United States Patent [19]

Boutron et al.

[11] 4,245,531

[45] Jan. 20, 1981

[54] DEVICE FOR TRANSFERRING TOBACCO LEAVES AND FOR CUTTING OUT WRAPPERS

[75] Inventors: Claude Boutron, Olivet; Robert Caffoz, Checy; Claude Juston, Saint-Jean-de-Braye, all of France

[73] Assignee: Service d'Exploitation Industrielle des Tabacs et des Allumettes, Paris, France

[21] Appl. No.: 74,534

[22] Filed: Sep. 11, 1979

[30] Foreign Application Priority Data

Sep. 15, 1978 [FR] France ..... 78 26493

[51] Int. Cl.[3] ..... B26D 7/08; B26D 7/06; B26D 1/02

[52] U.S. Cl. ..... 83/169; 83/409; 83/510; 131/33; 131/105

[58] Field of Search ..... 131/34, 33, 58, 73, 131/20 R, 28, 105; 83/510–512, 169

[56] References Cited

U.S. PATENT DOCUMENTS

| | | | |
|---|---|---|---|
| 3,154,987 | 11/1964 | Clausen | 83/510 X |
| 3,213,737 | 10/1965 | Wright | 83/510 X |
| 3,542,038 | 11/1970 | Hooper et al. | 131/105 X |
| 4,112,799 | 9/1978 | Daenen | 83/510 X |

*Primary Examiner*—Stephen C. Pellegrino
*Attorney, Agent, or Firm*—Holman & Stern

[57] ABSTRACT

A device for transferring a leaf-like material, such as tobacco leaves, and for cutting out pieces, such as wrappers for cigars, from said material. A drum is employed to remove the leaf-like material from a conveyor and to support the same during the cutting operation. The cutting device comprises a support with cutting members secured thereto, and the drum and support are moved relative to each other in such a manner that the drum presses the leaves into contact with the cutting members.

5 Claims, 5 Drawing Figures

DEVICE FOR TRANSFERRING TOBACCO LEAVES AND FOR CUTTING OUT WRAPPERS

The present invention relates to a device for transferring a leaf-like material, such as tobacco leaves, and for cutting out pieces, such as wrappers for cigars, from said material. This device takes its place in the automatized manufacture of cigar wrappers.

The wrappers were heretofore cut out one by one, on the cigar-wrapping machines, from previously stripped, moistened and spread out leaves. In the case of automatized manufacture of the wrappers, the leaves are moistened and/or spread out hydraulically; then the wrappers are cut out and stored, to be distributed subsequently to the wrapping machines. The leaves must therefore be transferred from the moistening and/or spreading out device to the device for cutting out the wrappers. The transfer may be effected in known manner either by suction from a feed conveyor, or manually when the locations of the various devices does not allow direct connection.

The object of the invention is a drum transfer device which allows connection between a feed conveyor, which may be the output conveyor of the spreading and moistening device, and a support on which are disposed cutting members. The device which is made simply and rationally allows a reduced handling of the leaves, said device cooperating with the cutting members after the transfer.

According to the invention, the cutting device comprises a support having cutting members secured thereto and the drum and the support are moved relative to each other during the cutting step in such manner that the drum presses the leaves into contact with the cutting members.

Thus, the leaf placed on the drum by rotation thereof in contact with the feed conveyor, is placed in contact with the support and displaced by said drum on the cutting members. The relative movement of the drum and the cutting members brings about the cutting of the wrappers from the leaf, the latter being constantly applied on said cutting members by the drum which then acts as a counter-piece. There are then two possible cases: in the first case, the support of the cutting members is movable and the drum rotates about its axis to apply the entire leaf on the cutting edges; in the other case, which is a preferred embodiment of the invention, the support of the cutting members is stationary and the drum is imparted a rotational motion and a translation motion which are combined so that the drum rolls without sliding on the cutting members in order to develop the leaf in contact with the cutting members.

The drum is advantageously coated with smooth rubber and the leaf is retained on its periphery by the action of a fluid. This fluid is preferably a film of water. In fact, the leaf which has just been moistened and/or spread out, for example by directing jets of water on its surface, is still covered by a film of water which creates on the rubber coating a suction effect. The parenchyma of the leaf will then adhere on the periphery of the drum and remain retained there during transfer and cut-out. At the moment of cut-out, only the wrappers will be drawn by suction, the pieces of leaves not used will remain applied on the drum.

In order to obtain a perfect synchronisation between transfer and cut-out, the diameter of the drum is such that the tobacco leaf occupies at maximum the half-circumference of said drum. In fact, in the particular case of the support of the cutting members being stationary and disposed parallel to the leaf feed conveyor, the drum, by a rotation of a half-revolution, places the forward end of the leaf in contact with the cutting members and begins its translation. To this end, the leaf must therefore be entirely taken up on the drum at the moment when cutting out is commenced.

The invention will be more readily understood on reading the following description with reference to the accompanying drawings, in which.

Figure 1:
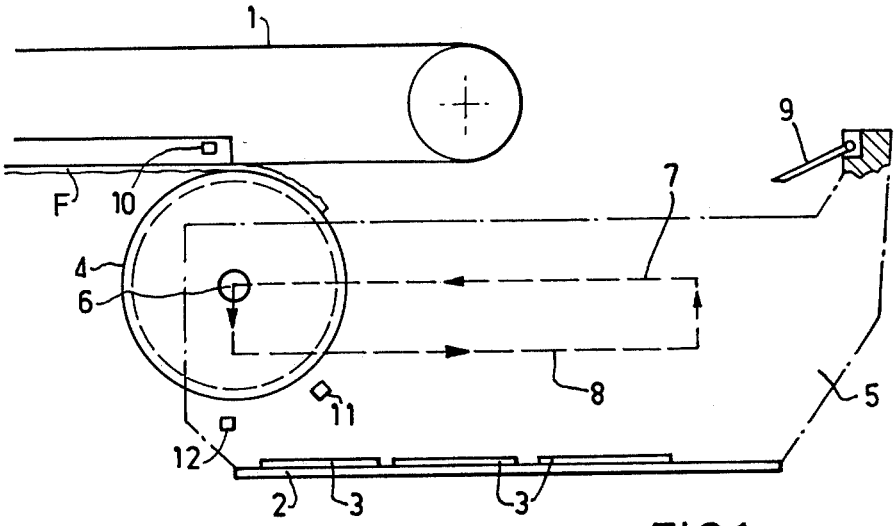
FIG. 1 shows a schematic view of the device according to the invention.

Referring now to the drawings, FIG. 1 shows the device which comprises a conveyor 1 for feeding leaves F, a support 2 on which are disposed cutting blades 3, and a transfer drum 4.

The conveyor 1 is an endless belt with suction action which may be the take-up conveyor at the output of a spreading-out device, employing jets of water. The leaves F are therefore spread out and maintained by suction on the lower side of the conveyor 1.

The support 2 which is stationary is disposed below the conveyor and bears cutters 3 enabling a maximum number of wrappers to be cut out from the whole leaf.

The transfer drum 4 is a cylinder coated with smooth rubber having a small perforated central suction zone which allows the taking of the leaf to be initiated, this zone corresponding substantially to the main rib of said leaf. However, provision of such a zone is not indispensable: the leaf, by its own moisture, adheres perfectly well on the rubber coating of the drum and the winding of the leaf on the surface of the drum may be initiated by any device such as a needle or scraper which would detach the leaf from the conveyor 1 and would apply it on the surface of the drum. The suction system solves the problem simply and in non-bulky manner. The suction zone makes it possible to draw the end of the leaf on its central part, the parenchyma spreading by itself, on either side, on the coating.

Figure 5:
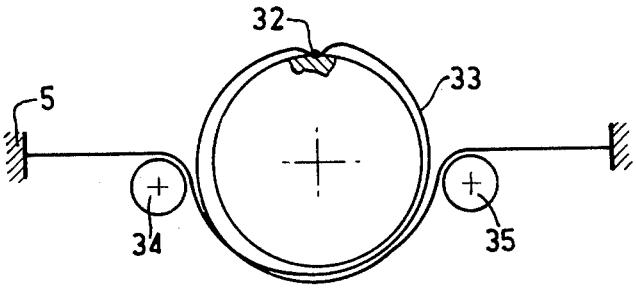
FIG. 5 is a detail view of a part of the drum driving device.
Figure 3:
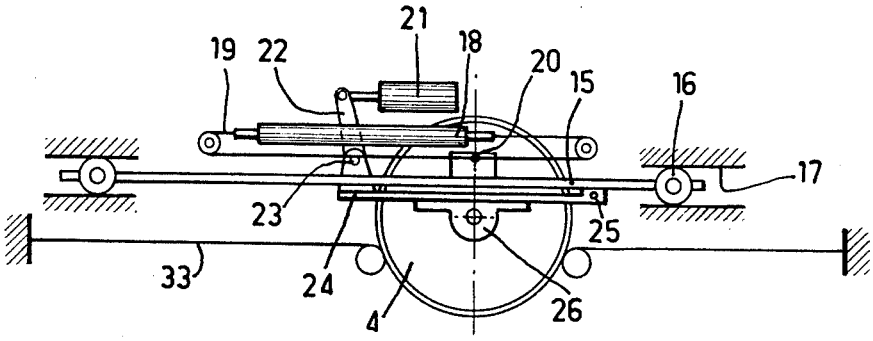
FIG. 3 shows a schematic view of the drum driving device.
Figure 4:
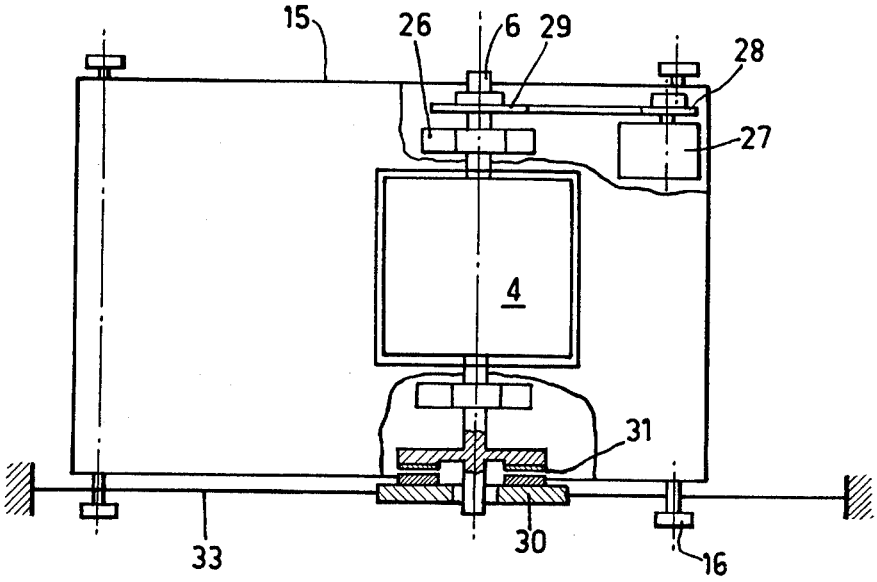
FIG. 4 is a plan view of the device of FIG. 3, some parts being omitted.

The transfer drum 4 is mounted on a frame 5 disposed between the conveyor 1 and the support 2. A driving device described below with reference to FIGS. 3 to 5 is designed so that the drum axis will travel along a rectangular path 7 shown in dotted line in FIG. 1 and also to rotate the drum about its axis. The path includes an upper horizontal portion in which the drum engages the conveyor and the end of which corresponds to the starting position, a descending portion, a lower horizontal portion in which the drum rolls without sliding on support 2, and a vertical upward portion after which the drum is returned to its starting point after having passed over a scraper 9 which is disposed so as to detach the pieces of leaves remaining on the periphery of the drum after the wrappers have been cut out.

The device operates as follows:

The leaves F are fed beneath the lower side of the conveyor 1 where they are maintained by suction. The passage of the leaf in front of a detector 10 actuates the rotation of the drum 4 at the linear feed speed of the leaf F and its application against the side of the conveyor.

The suction created in the central zone of the drum draws the end of the leaf to the periphery of the drum, the suction of the conveyor then being suppressed at the point of tangency. The leaf being highly moist, it is then held applied on the drum. The diameter of the drum is such that, when the forward end of the leaf reaches the lowermost position, the whole of the leaf is located on the drum. Detectors 11 and 12 are provided to control displacements of the drum at this stage. Detector 11 is so located that the distance therefrom to the point of tangency drum-conveyor, measured along the drum periphery, is equal to the largest possible dimension for a tobacco leaf, and detector 12 is positioned to face the lowermost point of the drum. The function of these detectors will be explained in more detail below in connection with the description of the drum driving device. The rotation of the drum is then stopped and it is displaced along the descending portion of the path to come to the level of the plane of the cutting edges. The rolling of the drum on these edges provokes the cut out of the wrappers which are sucked on the support 2, the portions of leaves which are not part of the wrappers remaining applied on the drum. The latter therefore acts, by its translation, as a counter-piece for the cutting edges 3.

After cut-out, the drum rises and the remaining parts of leaves are removed by the scraper 9. The drum thus cleaned is then returned to its starting position to begin a new cycle.

Figure 2:
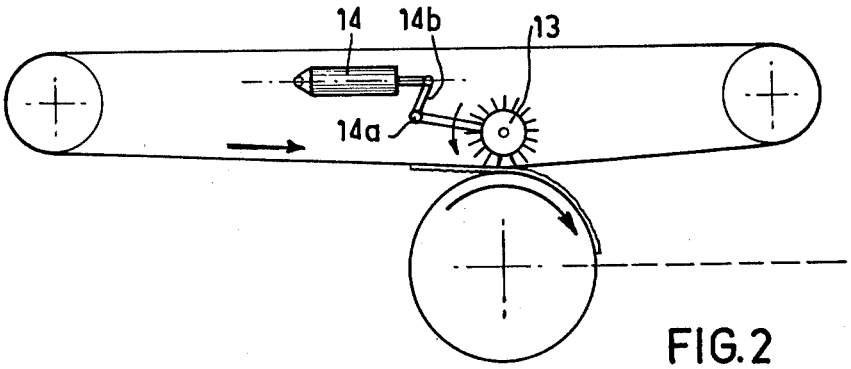
FIG. 2 shows a modified embodiment.

FIG. 2 shows a preferred modified embodiment of the invention, in which drum 4 does not engage the lower side of the conveyor in its starting position.

A metal brush 13 is provided above the lower side. The brush rotates freely about its axis and is displaceable between a high position and a low position. When the drum 4 is in its starting position and a tobacco leaf is fed, the brush 13 is lowered and presses the conveyor into engagement with the drum to allow the leaf to wrap round the drum. The brush may be actuated in any suitable manner e.g. by means of a piston and cylinder unit 14, the shaft of the brush being secured to a yoke mounted on a fixed pivot 14*a* and rigidly connected to a link 14*b* of variable length e.g. composed of two parts in telescopic arrangement.

The device for driving the drum will now be described with reference to FIGS. 3 to 5.

The drum 4 is secured for horizontal motion to a carriage 15 guided through rollers 16 in horizontal slides 17 secured to frame 5 of FIG. 1.

The horizontal displacement of carriage 15 is achieved by means of a piston and cylinder unit 18 associated with a cable 19 connected at a point 20 to a part fast with carriage 15.

The vertical displacements of drum 4 are achieved by means of a piston and cylinder unit 21 connected to carriage 15 and a link 22 of which one end is constrained to move along a vertical path. The displacement of said end brings about displacement of a plate 24 fast with drum 4 and connected at 25 to carriage 15 in such manner that it is vertically displaceable with respect to the carriage but secured with same for horizontal displacement. Plate 24 supports bearings 26 in which the shaft of drum 4 is rotatable.

A motor 27 is provided for rotating the drum 4, transmission from motor 27 to the shaft 6 of drum 4 being achieved by means of gears 28,29. There is mounted at the end of shaft 6 away from gear 29 a disc 30 of same diameter as drum 4 and capable of being coupled thereto by a clutching member 31. In addition, as best seen in FIG. 5, disc 30 is connected at one point 32 to a cable 33 having its ends secured to the frame 5 and passing over rollers 34,35 so as to form a loop round disc 30, the connection point 32 being located on said loop.

This arrangement enables drum 4 to roll without slide over the cutting members, disc 30 being then coupled with the drum, since it compels the linear speed of carriage 15 and the peripheral speed of drum 4 to be equal.

Disc 30 acts as a brake for the rotation of drum 4 about its axis under the action of motor 27, as such rotation can only occur when disc 30 is declutched.

An operating cycle of the device comprises the following steps in the case of the modification of FIG. 2.

In the first step, the drum 4 in its low position assumes the extreme left position and is driven for rotation by motor 27, disc 30 being declutched. Brush 13 is in its high, thus inoperative position.

When a tobacco leaf is fed, it is detected by cell 10, which causes downward pivoting motion of brush 13. The tobacco leaf wraps round the rotating drum.

As the forward end of the leaf reaches a point opposite cell 11, the latter produces a control signal to cause raising of the brush 13 and stop the motor 27.

The drum keeps on rotating by inertia and as the forward end of the leaf reaches the lowermost point of the drum, cell 12 produces a control signal to couple disc 30 with the drum, which is thus caused to stop.

In the subsequent step the cutting members are positioned depending on the shape of the leaf and other features. Once the cutting members have been disposed in convenient manner, the unit 21 moves carriage 15 towards the right (considering the drawings). Such motion, as already stated, implies rotation of disc 30, hence of drum 4 which is coupled therewith at this stage, so that the drum rolls without slide over the cutting members.

Once cutting is achieved, carriage 15 is stopped, disc 30 is declutched, motor 27 is started and unit 21 is actuated to raise the drum into its high position. The drum rotates by half a revolution, during which scraper 9 removes the remaining parts of the leaf from the surface of the drum.

At the end of this step, carriage 15 is moved towards the left and returns the drum to its starting position. The drum, always in its high position, keeps on being rotated by motor 27. The cable 33 wraps round disc 30.

Finally, carriage 15 is stopped and unit 21 lowers the drum 4. The next cycle may begin.

What is claimed is:

1. A device for transferring a leaf-like material, such as tobacco leaves, and for cutting out pieces, such as wrappers for cigars, from said material, comprising a leaf feed conveyor, a cutting device and means for transferring leaves from said conveyor to said cutting device, said means comprising a drum, wherein the cutting device comprises a support having cutting members secured thereto and the drum and the support are moved relative to each other during the cutting step in such manner that the drum presses the leaves into contact with the cutting members.

2. A device as claimed in claim 1, wherein the drum is imparted a rotational motion and a translation motion which are combined so that the drum rolls without sliding on the cutting members in order to develop the leaf in contact with the cutting members.

3. A device as claimed in claim 1, wherein said drum is coated with smooth rubber on which the leaf is maintained under the action of a fluid.

4. A device as claimed in claim 3, wherein the fluid is a film of water.

5. A device as claimed in claim 1, wherein the diameter of the drum is such that the tobacco leaf occupies at most one half of the circumference of said drum.

* * * * *